United States Patent [19]

Sidransky

[11] Patent Number: 4,615,659

[45] Date of Patent: Oct. 7, 1986

[54] OFFSET CENTRIFUGAL COMPRESSOR

[75] Inventor: Fred S. Sidransky, Rockford, Ill.

[73] Assignee: Sundstrand Corporation, Rockford, Ill.

[21] Appl. No.: 545,042

[22] Filed: Oct. 24, 1983

[51] Int. Cl.[4] ..... F01D 5/10; F01D 5/22

[52] U.S. Cl. ..... 416/183; 416/196 R; 416/231 B

[58] Field of Search ..... 416/183, 231 B, 194, 416/196 R; 415/DIG. 1

[56] References Cited

U.S. PATENT DOCUMENTS

| | | | |
|---|---|---|---|
| 1,622,930 | 3/1927 | von Karman et al. | 416/183 |
| 2,463,976 | 3/1949 | Kilchenmann | 416/183 |
| 2,920,864 | 1/1960 | Lee | 415/DIG. 1 X |
| 2,941,780 | 6/1960 | Von Der Nuell et al. | 253/39 |
| 3,075,743 | 1/1963 | Sheets | 415/DIG. 1 X |
| 3,627,447 | 12/1971 | Okapuu | 416/227 |
| 3,958,905 | 5/1976 | Wood | 416/183 |

FOREIGN PATENT DOCUMENTS

| | | | |
|---|---|---|---|
| 2360570 | 6/1974 | Fed. Rep. of Germany | 416/183 |
| 479427 | 1/1938 | United Kingdom . | |

OTHER PUBLICATIONS

Paper No. 43, Boyce et al., Investigation of Flow in Centrifugal Impeller with Tandem Inducer-presented at Gas Turbine Congress, Tokyo, Japan, 1977.

Paper No. 66—GT-83, Boyce, A Practical Three-Dimensional Flow Visualization Approach to the Complex Flow Characteristics in a Centrifugal Impeller-presented 1966-Gas Turbine Conference, Zurich, Switzerland.

*Primary Examiner*—Robert E. Garrett

*Attorney, Agent, or Firm*—Wood, Dalton, Phillips, Mason & Rowe

[57] ABSTRACT

An offset centrifugal compressor having a plurality of curved blades associated with a rotor and defining, respectively, inducer and exducer sections with a plurality of the blades being formed of at least three blade parts extending generally end-to-end. The adjacent ends of adjacent pairs of blade parts are indexed and immersed relative to each other in both the inducer and exducer section to form a pair of gaps through which a jet of gas may travel from the pressure side to the suction side of the blade to control boundary layer build-up and reduce separation of gas from the blade. An aerodynamically contoured bridge member is located in each gap to provide structural integrity and resonance frequency control, with these bridging members being positioned to avoid obstruction of gas flow in the area adjacent the tip of the blade.

3 Claims, 4 Drawing Figures

OFFSET CENTRIFUGAL COMPRESSOR

DESCRIPTION

1. Technical Field

This invention pertains to a centrifugal compressor having a rotor with blades having blade parts offset for control of the boundary layer to improve the performance, range and efficiency of the compressor. The rotor has both inducer and exducer sections and the blade parts are arranged to provide gas jets for boundary layer control in both sections to minimize gas separation from the blades as well as causing said separation to move closer to the tip of the blades with resulting reduction in the wake which occurs upon separation and which adversely affects the gas flow at the diffuser. Aerodynamically contoured bridging members are positioned between the immersed and indexed ends of the blade parts to provide structural integrity and blade section resonance frequency control, with these bridging members being located mid-span of the blades to not obstruct the flow of gas which has the maximum effect on boundary layer control.

2. Background Art

A centrifugal compressor has an internal structure through which gas flows from a gas inlet to a gas outlet, with the gas successively flowing through an inducer section, an exducer section and, thereafter, to a diffuser. Each of the inducer and exducer sections has blades which may be mounted on separate rotating members or may be mounted on a common rotor. A blade may extend continuously through both sections. Through studies and analysis, it has become well recognized that gas passing through the compressor can separate from the blade surfaces because of build-up in a boundary layer wherein there are fluid shear forces.

The Von Karman et al U.S. Pat. No. 1,622,930 generally referred to this problem and suggested providing gaps in the blades whereby gas could flow from a pressure face of the blade to the trailing face of the blade on the suction side. Von Karman describes the action in air rushing through the gaps acting to divert the entire current of air so that it will follow the form of the Von Karman's work dealt with boundary layer control in the inducer section of the compressor. Von Karman's structure was inadequate because of the lack of any blade resonance frequency control. The Wood U.S. Pat. No. 3,958,905, which also relates to boundary layer control in the inducer section, does disclose a damper pad in a gap between the blade parts in the inducer section, but with the damper pad positioned to obstruct gas flow through the gap where the gas flow is most effective for boundary layer control.

Others working in the field have developed a technique for visualizing flow through a compressor and have found separation regions in both the inducer and exducer sections of the centrifugal compressor and have suggested the use of a shaped slot intermediate the height of a blade in the exducer section which acts to divert gas from the pressure side to the suction side of the blade to move the separation region closer to the tip of the blade. This work found that the separation region occurred primarily at the tip of the blade remote from the rotor and adjacent a shroud. The slot in the blade was not located to direct the diverted gas directly into the separation region.

DISCLOSURE OF THE INVENTION

A primary feature of the invention is to provide an offset centrifugal compressor with provisions for boundary layer control in both the inducer and exducer sections thereof and which minimizes the potentially adverse effects from other factors such as Coriolis forces to improve the performance, range and efficiency of the compressor, particularly when the compressor must operate under adverse conditions.

An object of the invention is to provide an offset centrifugal compressor having a rotor with blades of multiple parts and with a pair of blade parts in the exducer section of the compressor having their adjacent ends indexed and immersed to provide a gap extending to the free edge of the blade for flow of gas from the pressure side to the suction side of the blade to provide improved boundary layer control, and with an aerodynamically contoured bridging member extending between the blade parts to provide structural integrity and resonance frequency control and with the bridging member positioned intermediate the height of the blade for nonobstructing relation with the gas passing through the gap adjacent the tip of the blade.

Still another object of the invention is to provide an offset centrifugal compressor, as defined in the preceding paragraph, wherein there are also separated blade parts in the inducer section of the compressor having their edges indexed and immersed to form a second gap in the inducer section and with there being a similarly mounted second aerodynamically contoured bridging member positioned therebetween.

A further object of the invention is to provide an offset centrifugal compressor having a plurality of blades associated with a rotor and having a length to extend axially of the rotor from a leading edge at the flow inlet end of the rotor and extend radially to an end at the outer periphery of the rotor to define respectively inducer and exducer sections, a plurality of said blades being formed of plural blade parts extending generally end-to-end with ends of a pair of adjacent blade parts of one blade being indexed and immersed relative to each other in said inducer section to form a gap, and with ends of another pair of blade parts being indexed and immersed relative to each other in said exducer section to form a second gap, whereby gas can flow through said gaps from the pressure side of said multi-part blades to the suction side thereof to affect the boundary layer on the suction side of said blades, and with there being an aerodynamically contoured bridging member fixed to adjacent blade parts in each of the gaps and located intermediate the height of the curved blades.

BEST MODE FOR CARRYING OUT THE INVENTION

Figure 1:
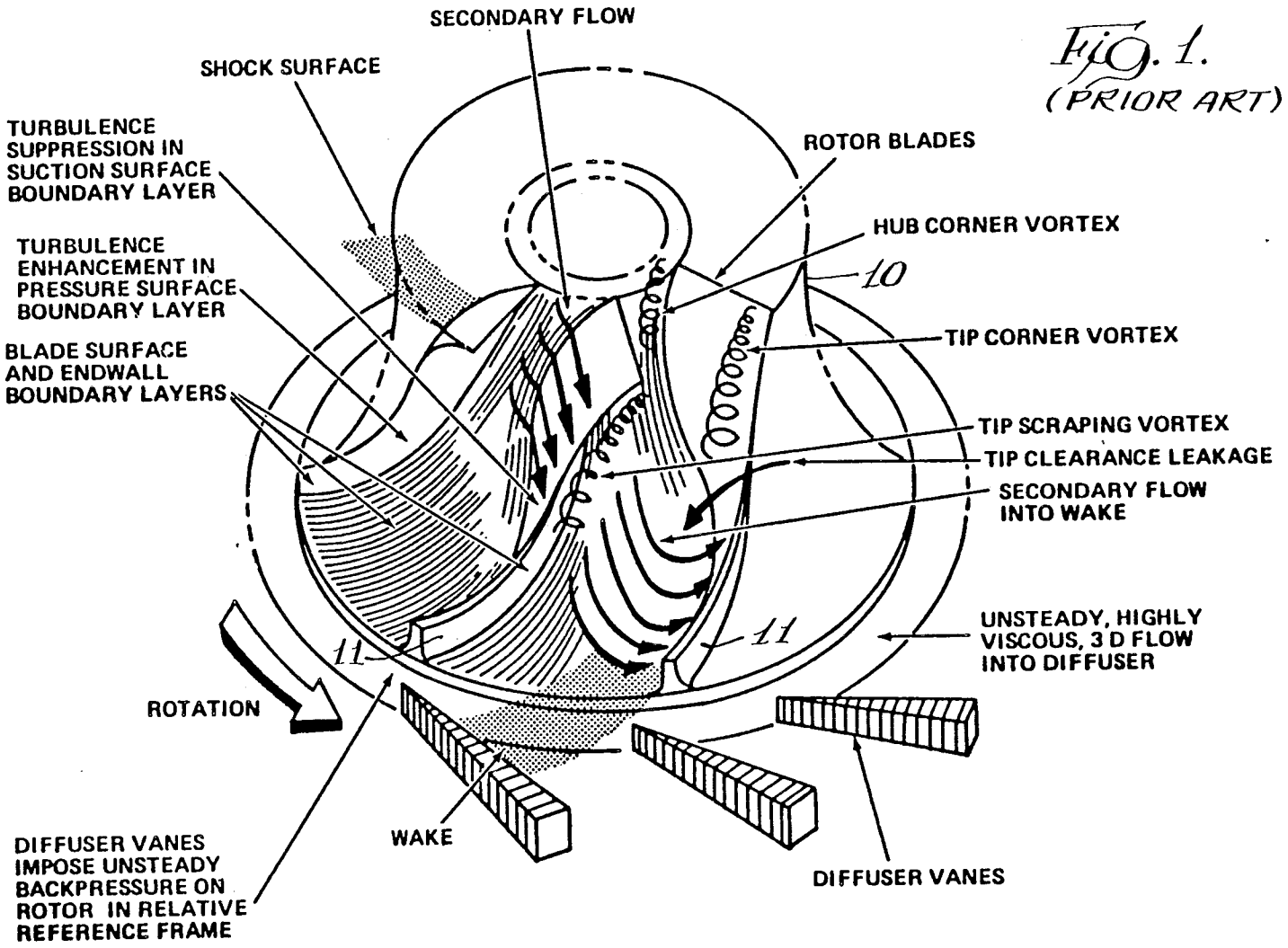
FIG. 1. (PRIOR ART)
FIG. 1 is a perspective view of parts of a conventional centrifugal compressor illustrating the complex movements of the gas as it flows through the compressor.

Prior to describing the structure embodying the invention, reference is made to a conventional compressor, as shown in FIG. 1, wherein the complex movements of gas as it flows from a compressor inlet to a compressor outlet are illustrated. A rotor 10 has a series of curved blades 11 and, as shown by the arrow, the rotor rotates in a counterclockwise direction. As the gas flows from a gas inlet to a diffuser, there are several vortices, secondary flows, and gas boundary layers, as labelled. Under highly-loaded rotor conditions or off-designs operation, a substantial wake results from gas separating from the trailing face, resulting in non-uniform or distorted flow entering the diffuser vanes, consequent loss in diffuser efficiency and the potential for premature diffuser stall and compressor surge.

Figure 2:
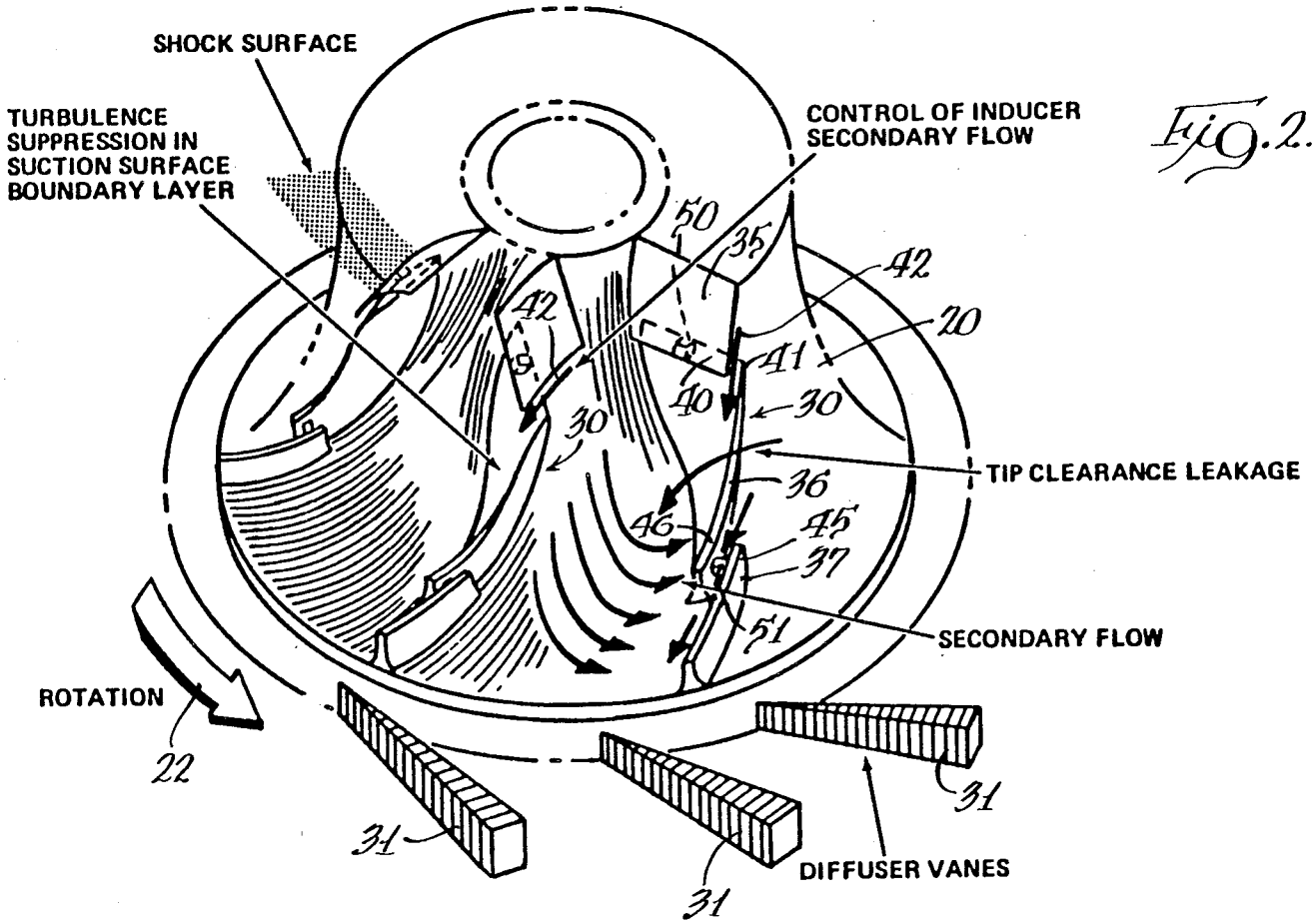
FIG. 2 is a view similar to FIG. 1 showing the offset centrifugal compressor embodying the invention and the reduction in the complex gas movement in flowing through the compressor.
Figure 4:
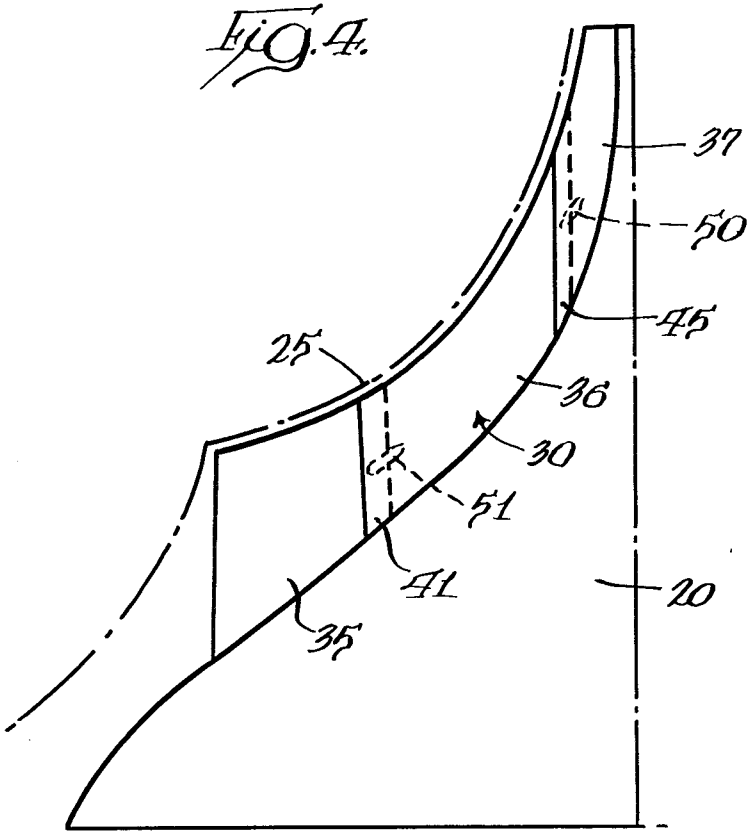
FIG. 4 is a view of the structure shown in FIG. 3 taken in a meridional plane.
Figure 3:
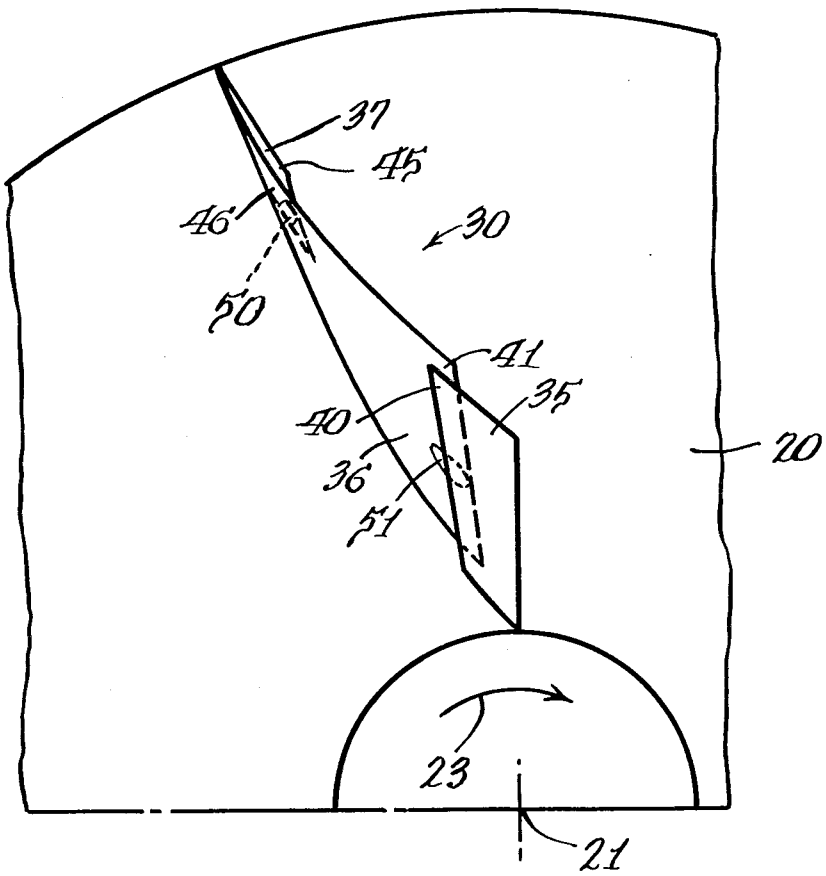
FIG. 3 is a fragmentary end elevational view of the rotor showing one of the offset blades.

An offset centrifugal compressor embodying the invention is shown in FIGS. 2–4. A rotor 20 is rotatable about an axis 21 in the direction of the arrows 22 and 23 in FIGS. 2 and 3, respectively. The rotor coacts with a stationary shroud (not shown) having a face shown in broken line at 25 in FIG. 4. A plurality of curved blades, indicated generally at 30, is mounted on the rotor and extend from a compressor inlet to a compressor outlet having a diffuser with diffuser vanes 31. Each of the blades 30 is formed of a plurality of blade parts 35, 36, and 37, with the blade 30 extending both axially and radially of said axis 21 to define inducer and exducer sections, respectively. The blade parts 35–37 are arranged successively in generally end-to-end relation, with the adjacent ends of a pair of adjacent blade parts being indexed and immersed relative to each other. More particularly, the blade parts 35 and 36 have their adjacent ends located in the inducer section of the compressor. The ends 40 and 41 of the blade parts 35 and 36 are indexed by being laterally offset to have the pressure face of the blade part end 40 positioned behind the suction face of the blade part end 41, with there being an overlap radially and thus being immersed relative to each other. The space between the ends of the blade parts 35 and 36 extends for the height of the blade and defines a gap for a limited flow of gas in the form of a jet, as indicated by the arrows 42 in FIG. 2, whereby there is boundary layer control and control of secondary flow in the inducer section of the compressor.

The blade parts 36 and 37 have adjacent ends 45 and 46 which are similarly indexed and immersed in the exducer section to provide a gap therebetween for limited flow of gas from the pressure face of the blade part 36 to the suction face of the blade part 37. The gas directed to the suction side of the blade part functions to minimize boundary layer build-up to reduce the wake at the outer periphery of the compressor rotor and have the air flowing in the form of a jet to achieve a good angle of attack and a more uniform flow distribution on the diffuser vanes 31. The gas directed through the gap moves the separation region where the gas leaves the suction side of the blades further outwardly toward the outer ends of the blades.

An aerodynamically contoured bridging member bridges the adjacent ends of adjacent blade parts to provide structural integrity and damping for resonance frequency control. A bridging member 50 is positioned in the gap between the blade part ends 40 and 41 and fixed thereto while a similar bridging member 51 is positioned between, and fixed to, the blade end parts 40 and 41 in the inducer section. These bridging members are shaped similarly to an airfoil and are located at midspan approximately mid-way of the height of the blade 30 to minimize obstruction of the gas jet moving through the gaps and to be out of obstructing relation with that portion of the gas jet adjacent the tip of the blade which is remote from the rotor 20, which is the primary area in which the gas tends to separate from the suction side of the blade.

From the foregoing, it will be evident that the offset centrifugal compressor has blades with two gaps located in the inducer and exducer sections thereof, respectively. The first blade gap, located in the inducer section, overcomes the adverse effects derived from inlet duct boundary development as well as poor inlet flow alignment. The second blade gap in the exducer section permits gas flow to suppress potential separation resulting from excessive diffusion on the suction side of the blade with resulting reduction in the creation of a wake which adversely affects gas flow into the diffuser.

Further, the invention embodies the use of the aerodynamically contoured bridging members and which are positioned to minimize the effect on the flow through the gaps. Reference has been made to indexing and immersion of adjacent ends of adjacent blade parts. The indexing provides the lateral offset to give a dimension to the gap and control the amount of gas that flows therethrough, while the immersion provides an overlap to control the direction of the jet flow of gas through the gap. Generally, the index distance should not exceed 10% of the distance between adjacent blades in order to avoid destroying the gas flow field through the compressor.

I claim:

1. An offset centrifugal compressor having a plurality of blades associated with a rotor and having a length to extend axially of the rotor from a leading edge at the flow inlet end of the rotor and extend radially to an end at the outer periphery of the rotor to define respectively inducer and exducer sections, a plurality of said blades being formed of plural blade parts extending generally end-to-end with ends of a pair of adjacent blade parts of one blade being indexed and immersed relative to each other in said inducer section to form a gap, and with ends of another pair of blade parts being indexed and immersed relative to each other in said exducer section to form a second gap, whereby gas can flow through said gaps from the pressure side of said multi-part part blades to the suction side thereof to affect the boundary layer on the suction side of said blades and a generally airfoil-shaped bridging member in each gap and fixed to said indexed and immersed ends of said blade parts at a location approximately mid-way of the height of the blades to provide for unobstructed flow of gas through said gaps adjacent the tip of the blade remote from the rotor.

2. An offset centrifugal compressor having a rotor for association with a shroud and operable to compress gas received at a compressor inlet and discharged at a compressor outlet, said rotor having blades defining an inducer section and an exducer section, a plurality of said blades having two successive blade parts, with their adjacent ends indexed and immersed in said exducer section to define a gap, and an airfoil-shaped bridging member fixed to the blade parts in said gap at a distance from the tip of the blade and approximately mid-way the height of the blade.

3. A centrifugal compressor compressing gas flowing between a compressor inlet and a compressor outlet and having a rotor rotatable about an axis, said rotor having blades generally extending both axially and radially of said axis to define inducer and exducer sections, said blades having a pressure face facing the direction of rotor rotation and a trailing face, a plurality of said blades being discontinuous to define plural blade parts which are indexed and immersed in a direction to have a portion of a pressure face of one blade part behind the trailing face of a blade part further from said axis to define gaps extending for the height of the blade and open at the tip of the blade whereby gas can flow through said gaps from a pressure face of one blade part to the space behind a trailing face of an adjacent blade part and a pair of airfoil-contoured bridging members positioned one in each of said gaps and fixed to the blade parts to provide structural integrity and damping for resonance control and located approximately midway the height of the blade whereby there can be unobstructed gas flow through the part of the gaps which are radially outward of the bridging members.

* * * * *